United States Patent [19]

Carlisle et al.

[11] Patent Number: 4,816,785

[45] Date of Patent: Mar. 28, 1989

[54] MULTIPACTOR DEVICE WITH RADIOACTIVE ELECTRON SOURCE

[75] Inventors: Thomas P. Carlisle, Rolling Hills Estates; Mark R. Thek, Redondo Beach; Rudolph G. Suchannek, Santa Monica, all of Calif.

[73] Assignee: Hughes Aircraft Company, Los Angeles, Calif.

[21] Appl. No.: 140,180

[22] Filed: Dec. 31, 1987

[51] Int. Cl.[4] ..... H01P 1/14; H01J 17/64

[52] U.S. Cl. ..... 333/99 MP; 315/39.63; 333/13; 333/258; 333/262

[58] Field of Search ..... 333/99 MP, 13, 258, 333/262; 315/39, 39.63; 250/493.1

[56] References Cited

U.S. PATENT DOCUMENTS 2,674,694 4/1954 Baker ..... 333/99 MP 3,354,349 11/1967 Horn ..... 315/39

3,858,125 12/1974 Nelson et al. ..... 333/99 P X 4,199,738 4/1980 Carlisle et al. ..... 333/258

4,245,197 1/1981 Goldie ..... 333/99 MP

*Primary Examiner*—Marvin L. Nussbaum

*Attorney, Agent, or Firm*—Paul M. Coble; A. W. Karambelas

[57] ABSTRACT

The disclosed multipactor device has a waveguide bandpass filter structure including a plurality of spaced pairs of opposing electrodes defining respective gaps therebetween in which multipactor action can occur in response to input microwave power in excess of a predetermined level. A radioactive source of beta particles provides electrons within the bandpass filter structure to ensure a very rapid commencement of multipactor action. The radioactive source includes a disk coated with a tritium compound and mounted in a transverse bore adjacent to the bandpass filter structure.

9 Claims, 1 Drawing Sheet

MULTIPACTOR DEVICE WITH RADIOACTIVE ELECTRON SOURCE

TECHNICAL FIELD

This invention relates to microwave power switching, and more particularly relates to a multipactor switching device for microwave power in which a radioactive electron source is employed to supply electrons to the multipactor region.

BACKGROUND OF THE INVENTION

In certain types of radar systems a T-R (transmit-receive) switch is employed to block microwave signals above a given power level, while passing signals below the given power level, thereby preventing excessive bursts of power from destroying the receiving equipment. One type of device which has been employed for this purpose is a gas discharge switching tube. In the operation of such tubes a substantial recovery time during which signals cannot be received exists after each discharge; hence the pulse repetition rate of systems incorporating this type of switch is severely limited.

Another type of device which has been employed for microwave power switching utilizes a secondary electron resonance phenomenon termed "multipacting". In multipactor devices a radio frequency electric field is applied to an evacuated chamber including a pair of spaced opposing surfaces each having a secondary electron emission coefficient greater than unity. If the radio frequency electric field is of sufficient amplitude and if the frequency of the electric field is properly related to the surface spacing, electrons will be emitted from one surface and accelerated toward the opposite surface where they will arrive when the electric field reverses its polarity. Secondary electrons will be emitted from the opposite surface, and if the yield of secondary electrons is greater than one, more electrons will be emitted from this surface than impinged upon it. Since the electric field reverses its polarity as the secondary electrons are emitted, these secondary electrons will be accelerated back to the first surface from which they will release new secondary electrons at the same time the electric field reverses its polarity. Thus, the process continues as electrons are accelerated back and forth between the surfaces in synchronism with the alternating electric field. The net result is to establish multipactor action, i.e., electron multiplication in a synchronous alternating electric field between secondary electron emissive surfaces.

The aforedescribed phenomenon may be utilized to provide radio frequency power switching because when the input power to a multipactor switch is greater than the level required to sustain multipactor action, radio frequency power is absorbed by the electrons and is dissipated when these electrons strike the secondary electron emissive surfaces, thereby limiting the power transmitted through the switch to a predetermined lower level.

In previous multipactor switches, a thermionic electron emissive electrode has been employed to provide the multipactor region of the switch with electrons and thereby ensure a rapid commencement of multipactor action in response to an input signal above a given power level. Such an arrangement requires a power supply to provide heating current sufficient to cause thermionic emission of electrons from a cathode or filament, and when the cathode is located externally of the multipactor chamber, a second power supply is required to bias the cathode sufficiently negatively with respect to the multipactor chamber so that the emitted electrons are accelerated into the multipactor region. Further details concerning the aforedescribed multipactor switching devices may be found in U.S. Pat. Nos. 2,674,694 to W. R. Baker, 3,354,349 to K. L. Horn, and 4,199,738 to T. P. Carlisle et al.

SUMMARY OF THE INVENTION

It is an object of the present invention to provide a multipactor device which retains the aforementioned rapid turn-on characteristics while eliminating the need for a thermionic electrode and its associated power supplies.

It is a further object of the invention to provide a fast acting, simple, reliable, and durable multipactor switching device of smaller size, reduced weight, and less cost than otherwise comparable devices of the prior art.

It is still another object of the invention to provide a multipactor switch of exceptionally long life.

A multipactor device according to the invention includes a waveguiding structure having a plurality of spaced pairs of opposing electrodes defining respective gaps therebetween wherein multipactor action can occur in response to input microwave power in excess of a predetermined level. A radioactive source of beta particles provides electrons within the waveguiding structure to ensure a rapid commencement of multipactor action in response to an input signal above a given power level.

Additional objects, advantages, and characteristic features of the present invention will become readily apparent from the following detailed description of a preferred embodiment of the invention when considered in conjunction with the accompanying drawings.

DETAILED DESCRIPTION OF THE INVENTION

Figure 1:
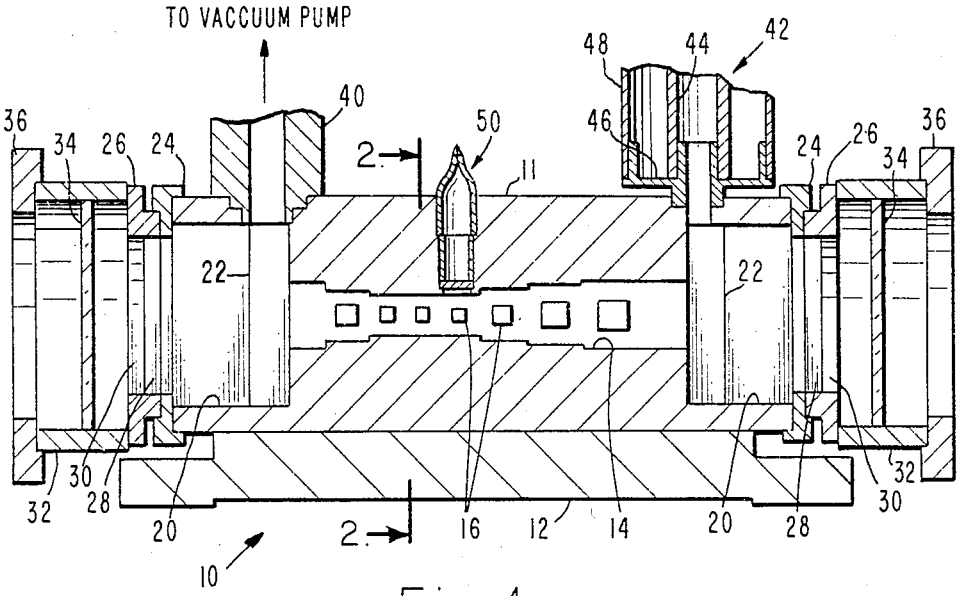
FIG. 1 is a longitudinal sectional view illustrating a multipactor device in accordance with the present invention.
Figure 2:
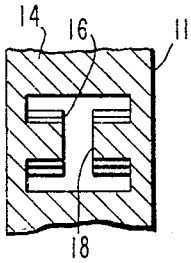
FIG. 2 is a cross-sectional view taken along line 2—2 of FIG. 1.

Referring to FIGS. 1 and 2 with greater particularity, a multipactor device 10 according to the invention may be seen to include a metal housing 11, of copper, for example, mounted on a support 12. The interior of the housing 11 defines a waveguiding structure 14 for propagating electromagnetic waves within a predetermined frequency range. Although the wave propagating structure 14 may be of various configurations such as a rectangular waveguide, a ridged waveguide, or an interdigital transmission line, in the illustrated embodiment the waveguide 14 takes the form of a comb-like bandpass filter structure. Thus, the wave propagating structure 14 may comprise a rectangular waveguide in which a plurality of pairs of aligned teeth 16 and 18 project inwardly from opposing lateral waveguide walls.

In order to provide desired impedance matching, as shown in FIG. 1, the waveguide 14 is progressively stepped inwardly in height as a function of distance from its opposite ends such that its height is smallest in the middle region and greatest in its end regions. The cross-sectional area of the teeth 16 and 18 is similarly varied such that the smallest teeth reside in the middle region of the waveguide 14 and the largest teeth are disposed near the respective ends of the waveguide 14. The opposing surfaces of the teeth 16 and 18 may be coated or otherwise provided with a layer of a secondary electron emissive material (i.e., a material having a secondary electron emission coefficient greater than unity) in order to enhance multipactor action.

Each end of the waveguide 14 opens into an impedance-transforming section 20, which may be a standard rectangular X-Band waveguide, for example, and which waveguide section has a greater height and width than the waveguide 14. The interior portion of each waveguide section 20 is provided with an impedance-transforming inwardly projecting step 22. A waveguide adaptor 24, which may be of stainless steel, for example, is attached to the outer end of each waveguide section 20, while a rectangular-to-round waveguide transition member 26, of iron, for example, is attached to the outer side of each adaptor 24. The adaptor 24 facilitates brazing of the transition member 26 to the waveguide section 20 and also affords control of the overall length of the multipactor device 10. The transition member 26 defines a rectangular waveguide portion 28 adjacent to the adaptor 24 and further defines a circular waveguide portion 30 away from the adaptor 24.

Secured to the outer side of each transition member 26 is a circular waveguide section 32. A circular disk 34 of a dielectric material such as alumina is mounted within each waveguide section 32 and sealed to the inner walls thereof. The disk 34 functions as a vacuum window which enables the interior regions of the multipactor device 10 to be maintained at a reduced pressure while enabling microwave energy to readily pass through and thereby enter and leave the interior of the multipactor device. The outer end of each waveguide section 32 is attached to a flanged mounting element 36 to facilitate coupling to an external waveguide or other microwave transmission line (not shown). The various elements 36, 34 32, 26, 24 and 20 may be secured to one another by brazing, for example.

Attached to and communicating with the interior of the waveguide housing 11 adjacent to step 22 at one end of the waveguide 14 (preferably the input end) is a tube 40 which is connected to a vacuum pumping arrangement (not shown). The vacuum pumping arrangement enables the interior regions of the multipactor device 10 to be maintained at a reduced pressure, for example $10^{-6}$ torr, and may also include an ion pump for ionizing gas molecules within the multipactor device 10 and removing resultant ions from the interior of the device.

Attached to the waveguide housing 11 and communicating with the interior thereof adjacent to the step 22 at the other end of the waveguide 14 is an oxygen leak 42. The oxygen leak 42 may include a thin silver tube 44 coaxially mounted on an annular support 46, which may be of nickel-plated stainless steel, for example, within an outer shielding tube 48, of stainless steel, for example. When the tube 44 is heated to a desired temperature (for example, 500° C.), oxygen molecules outside of the tube 44 permiate through the wall of the tube 44 and enter the interior regions of the multipactor device 10. These oxygen molecules serve to oxidize the coating on the teeth 16 and 18 and thereby counteract the reducing action caused by impinging electrons on the secondary electron emissive material.

Figure 3:
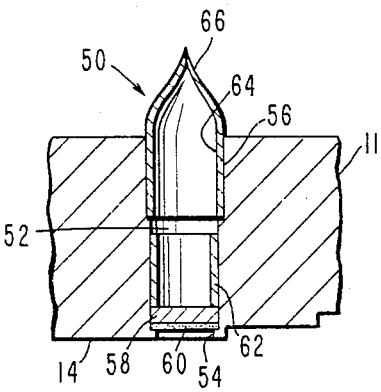
FIG. 3 is an enlarged sectional view showing the radioactive electron source portion of the device of FIG. 1.

In accordance with the principles of the present invention, a radioactive source arrangement 50 of beta particles is included in the multipactor device 10 to provide electrons in the interior regions of the waveguide 14 where multipactor action occurs and thereby ensure a rapid commencement of multipactor action in response to an input signal above a given power level. As shown in detail in FIG. 3, the radioactive source 50 is disposed in a transverse bore 52 in the housing 11 extending between the waveguiding surface 14 and the exterior of the multipactor device 10. The bore 52 defines an inwardly projecting annular flange 54 at its end adjacent to the waveguide 14 and a slightly enlarged bore portion 56 away from the waveguide 14. A metal disk 58, which may be of copper, for example, is supported within the bore 52 by the flange 54. The broad surface of the disk 58 facing the waveguide 14 is provided with a coating 60 of radioactive material.

In a preferred embodiment of the invention, tritium ($H_3$) is employed as the radioactive material. This may be achieved by using a coating 60 of titanium tritide or scandium tritide, for example. The coating 60 may be applied to the disk 58 by first vapor depositing titanium or scandium onto the disk 58 to serve as a gettering material and subsequently heating the coated disk in a tritium atmosphere so that the titanium or the scandium on the disk absorbs tritium and forms titanium tritide or scandium tritide, respectively.

Exemplary amounts of radioactive material which may be employed in the radioactive source 50 range from about 0.034 currie to about 0.34 currie (1 currie is a unit of radioactivity equal to $3.7\times10^{10}$ radioactive particles per second). As an example solely for illustrative purposes, for a copper disk 58 of a diameter of 0.207 inch and a thickness of 0.01 inch, a titanium tritide coating 60 may be provided in an amount furnishing 1 currie per square inch. This amount of radioactive material provides an electron current (of approximately 6000 eV electrons) on the order of nanoamps. Although this current is smaller than that provided by thermionic electron sources of the prior art, it has been found that the transmitted microwave energy that occurs at the onset of multipactor action decreases only slightly as the electron current is increased substantially from the aforementioned nanoamp range. Thus, electron currents on the order of nanoamps are able to achieve a very rapid initiation of multipactor action without excessive leakage of microwave energy.

The disk 58 is held in place within the bore 52 by means of a tubular sleeve 62, which may be of copper, for example, having an outer diameter substantially the same as the diameter of the bore 52. After the disk 58 has been inserted in the bore 52 in its desired position against the flange 54, the sleeve 62 is placed in the bore 52 against the disk 58 and may be mechanically flared slightly using an appropriate tool so that it snuggly embraces the walls of the bore 52 and firmly holds the disk 58 against the flange 54.

Disposed within and brazed to the enlarged bore portion 56 is pinched-off tube 64, which may also be of copper, for example. Since brazing temperatures would remove radioactive material from the coating 60, the disk 58 and the sleeve 62 are mounted within the bore 52 after brazing the tube 64 to the bore 56. After the disk 60 and the sleeve 62 are inserted into the bore 52 through the then open tube 64 and mounted in their desired positions, the outer end of the tube 64 is pinched-off as shown at 66 to form a hermetic seal. It is further pointed out that any vacuum pumping operation for the multipactor device 10 that occurs at an elevated temperature after the disk 58 has been mounted in the bore 52 will result in the removal of some radioactive material from the coating 60. Therefore, a sufficient amount of radioactive material should initially be provided in the coating 60 to allow for the loss of some material during subsequent elevated temperature processing. In the case of titanium tritide, it has been found that the rate of removal of tritrium molecules increases significantly at temperatures above 200° C.; hence all processing of the device 10 after the disk 58 has been mounted in the bore 52 should be done at temperatures below about 200° C.

It will be apparent that a multipactor device 10 according to the invention is able to provide sufficient electrons within the waveguide 14 to ensure a very rapid commencement of multipactor action in response to an input signal above a given power level, and in a device that is simple, reliable and durable. Moreover, since the need for a thermionic electrode and its associated power supplies is eliminated, a multipactor device according to the invention is smaller, lighter and less costly than otherwise comparable devices of the prior art. In addition, since the life of the electron source 50 is determined by the half-life of the radioactive material employed (tritium has a half-life of 12.2 years), a multipactor switch of exceptionally long life is afforded.

Although the invention has been shown and described with reference to a particular embodiment, nevertheless, various changes and modifications which are obvious to a person skilled in the art to which the invention pertains are deemed to lie within the spirit, scope, and contemplation of the invention.

What is claimed is:

1. A multipactor device comprising:

a housing member defining a waveguiding structure including a plurality of spaced pairs of opposing electrodes defining respective gaps therebetween wherein multipactor action can occur in response to input microwave power in excess of a predetermined level and further defining a transverse bore communicating with the interior of said waveguiding structure;

a disk mounted in said bore adjacent to said waveguiding structure, said disk having a broad surface facing the interior of said structure; and a coating of electron emissive radioactive material on said broad surface.

2. A multipactor device according to claim 1 wherein said coating is of titanium tritide.

3. A multipactor device according to claim 1 wherein said coating is of scandium tritide.

4. A multipactor device according to claim 1 wherein said disk is of copper.

5. A multipactor device according to claim 1 wherein said coating contains between about 0.034 and 0.34 curie of said radioactive material.

6. A multipactor device according to claim 1 wherein said broad surface of said disk lies substantially parallel to an adjacent interior wall of said waveguiding structure.

7. A multipactor device according to claim 1 wherein said bore is provided with an inwardly projecting annular flange at its end adjacent to the interior of said waveguiding structure, and said disk is mounted in said bore against said flange.

8. A multipactor device according to claim 7 and further including a tubular sleeve snuggly disposed in said bore behind said disk to firmly hold said disk against said flange.

9. A multipactor device according to claim 1 and further including a pinched-off tube mounted in said bore at its end away from said waveguiding structure and hermetically sealed to said housing member.

* * * * *